United States Patent [19]

Koga

[11] Patent Number: 5,029,561

[45] Date of Patent: Jul. 9, 1991

[54] CHAIN SAW

[75] Inventor: Hiroaki Koga, Sayama, Japan

[73] Assignee: Kioritz Corporation, Tokyo, Japan

[21] Appl. No.: 519,210

[22] Filed: May 3, 1990

[30] Foreign Application Priority Data

May 24, 1989 [JP] Japan ..... 1-59154[U]

[51] Int. Cl.[5] ..... F02N 3/02

[52] U.S. Cl. ..... 123/185 B; 30/381

[58] Field of Search ..... 123/185 BA, 185 B, 185 A; 30/381, 383

[56] References Cited

U.S. PATENT DOCUMENTS 3,844,360 10/1974 Green et al. ..... 173/170
3,849,883 11/1974 Kolorz ..... 30/381
4,370,809 2/1983 Takahashi et al. ..... 30/381
4,694,578 9/1987 Kemmler ..... 30/383
4,765,282 8/1988 Nagashima ..... 123/41.7
4,799,468 1/1989 Farquhar ..... 123/400

FOREIGN PATENT DOCUMENTS 59-206676 11/1984 Japan ..... 123/185 A

*Primary Examiner*—Andrew M. Dolinar
*Attorney, Agent, or Firm*—Browdy and Neimark

[57] ABSTRACT

A chain saw provided an internal combustion engine having a recoil-type starter. The chain saw has a step provided on the machine frame of the chain saw and adapted to be stepped down by at least a portion of the user's foot when the user operates the starter for starting the engine.

1 Claim, 1 Drawing Sheet

CHAIN SAW

BACKGROUND OF THE INVENTION

The present invention relates to a chain saw provided an internal combustion engine having a recoiltype starter.

In general, a chain saw has an air-cooled 2-stroke cycle internal combustion engine as a power source mounted on a frame. The engine is, in most cases, of a type which is started by a recoil starter. The user, when starting the engine, pulls a recoil rope by right hand, while holding a front handle by left hand, with right knee supporting a portion of the machine frame, e.g., an end of a rear handle. When the chain saw is of so-called top-handle type which has no rear handle projecting rearward and which is usually small in size, it is impossible to stably hold the machine frame when pulling the recoil rope, so that the user cannot exert full force in pulling the rope. This makes it difficult to start the engine and, in some cases, causes a danger of jump of the machine frame.

SUMMARY OF THE INVENTION

Accordingly, an object of the present invention is to provide a simple and easily-usable chain saw, while elimianting the above-described problems of the prior art.

To this end, according to the present invention, there is provided a chain saw provided an internal combustion engine having a recoil-type starter, characterized by comprising a step on which at least a part of a foot of the user can be placed.

In starting the engine, the user can place his foot on the step so as to stably fix the machine, so that he can easily pull the recoil rope, thus attaining an easy start of the engine. In addition, since only one hand is occupied, the user can control the throttle lever by the other hand. The necessity for the throttle lock is therefore eliminated.

DESCRIPTION OF THE PREFERRED EMBODIMENT

Figure 1:
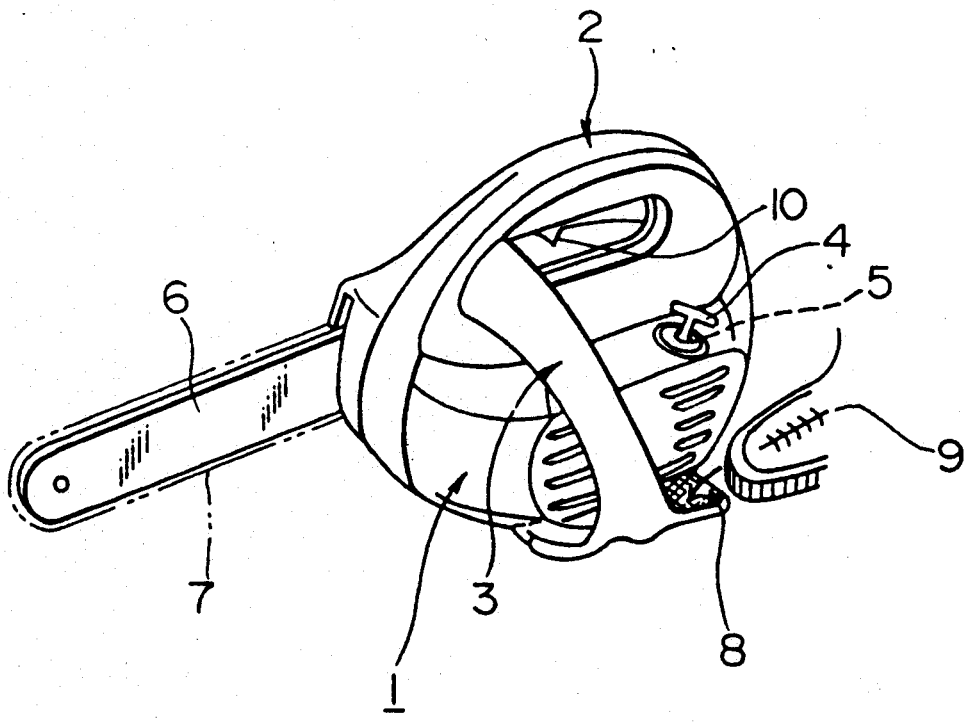
FIG. 1 is a perspective view of a preferred embodiment of the chain saw of the present invention.

A preferred embodiment of the invention will be described with reference to the accompanying drawing.

Referring to FIG. 1, there is shown a chain saw embodying the present invention. This chain saw is of a so-called top-handle-type, and has a machine frame 1 in the form of a hollow case made of a synthetic resin. A handle 2 to be held by the user's right hand is formed on the top of the machine frame 1 integrally therewith. The handle 2 is provided with a throttle trigger 10. Another handle 3 to be held by the user's left hand is provided on the left side portion of the machine frame 1 so as to extend from a front upper portion to a central lower portion of the machine frame 1. An air-cooled compact 2-stroke cycle internal combustion engine (not shown) as a power source is mounted in the machine frame 1. The internal combustion engine has a recoil starter (not shown) which also is disposed in the machine frame 1. The recoil starter has a recoil rope with a grip 4 on its end extremity. The group 4 projects upward from a hole 5 formed in a left side portion of the machine frame 1. A chain guide bar 6 is provided on the right front portion of the machine frame 1 so as to project forwardly therefrom. A saw chain 7 is extended and around the chain guide bar so as to run along the chain guide bar when powered by the engine, thereby to cut, for example, trees.

The handle 3 for the left hand is provided at its lower end with a substantially flat step 8 which extends rearward in the longitudinal direction of the chain saw along the left side edge of the bottom of the machine frame 1. The step 8 is suitably formed at its upper surface so as to prevent any slip of a user's shoe placed thereon. The step 8 is sized to be large enough to enable the user to step down it by at least a portion of one of the feets against the ground thereby stably holding the machine frame 1.

When starting the engine, the user holds the top-handle with a hand, e.g., the left hand, while stepping down the step 8 by his foot 9 so as to hold the machine frame 1 stably on the ground. The user then grips the grip 4 of the recoil rope of the recoiltype starter with the right hand and strongly pulls the recoil rope so that the starter operates to safely start the engine without fail.

In the described embodiment, the step portion 8 is formed integrally with the handle 3 for the left hand. The step 8, however, may be provided on any suitable portion of the machine frame 1.

What is claimed is:

1. A chain saw provided an internal combustion engine having a recoil-type starter, comprising a substantially flat step adapted to be stepped down by at least a part of the user's foot, said step extending rearward in the longitudinal direction of said chain saw along the adjacent bottom side edge of the machine frame of said chain saw at the lower end of a handle provided on the machine frame.

* * * * *